US007389889B2

(12) United States Patent
Roodenburg et al.

(10) Patent No.: US 7,389,889 B2
(45) Date of Patent: Jun. 24, 2008

(54) HOISTING MECHANISM

(75) Inventors: Joop Roodenburg, Ha Delft (NL); Eric Romein, Zuid-Beijerland (NL)

(73) Assignee: Itrec B.V., Schiedam (NL)

( * ) Notice: Subject to any disclaimer, the term of this patent is extended or adjusted under 35 U.S.C. 154(b) by 131 days.

(21) Appl. No.: 11/321,398

(22) Filed: Dec. 29, 2005

(65) Prior Publication Data

US 2006/0124571 A1 Jun. 15, 2006

(51) Int. Cl.
*B66C 23/53* (2006.01)

(52) U.S. Cl. ..... 212/308; 254/900

(58) Field of Classification Search ..... 212/308; 254/900

See application file for complete search history.

(56) References Cited

U.S. PATENT DOCUMENTS 3,871,527 A 3/1975 Schimmeyer
4,025,055 A 5/1977 Strolenberg
4,155,538 A 5/1979 Claassen
4,179,233 A * 12/1979 Bromell et al. ..... 414/138.3

FOREIGN PATENT DOCUMENTS

| | | |
|---|---|---|
| FR | 2224395 | 10/1974 |
| FR | 2390365 | 12/1978 |
| NL | 7508496 | 2/1976 |

* cited by examiner

*Primary Examiner*—Thomas J. Brahan
(74) *Attorney, Agent, or Firm*—Buskop Law Group, PC; Wendy Buskop

(57) ABSTRACT

The embodied hoisting mechanism has a hoisting cable, a hoisting-cable drive, a frame and a jib that can be topped. Hoisting-cable drive means form a path for the hoisting cable. A displaceable hoisting-cable guide is used with the hoisting cable so that the displacement of the displaceable hoisting-cable guide changes the length of the path. The displaceable hoisting-cable guide has an associated first hydraulic component with a first chamber that can be connected to a second hydraulic component with a second chamber of variable volume. A pressure source is coupled to the second hydraulic component in order to maintain a substantially constant hydraulic pressure in the second chamber. A pressure-limiting valve assembly, which is partially actuated by a topping-means loading sensor, is incorporated in the connection.

14 Claims, 8 Drawing Sheets

HOISTING MECHANISM

CROSS REFERENCE TO RELATED APPLICATIONS

The present application claims priority to co-pending International Application Number PCT/NL2004/000450 filed on Jun. 24, 2004, which claims priority to Netherlands Patent Application Number NL1023814 filed on Jul. 3, 2003.

FIELD

The embodiments relate to hoisting mechanisms.

BACKGROUND

In the known hoisting mechanisms, the displaceable hoisting-cable guide, by interacting with the hydraulic components and the pressure source, causes shock loads on the hoisting cable, which act as shock loads on the hoisting mechanism, to be absorbed. In this context, the known pressure source is designed as a gas-filled reservoir, in which case the variation in the volume of the second chamber, which is filled with hydraulic fluid, does not have any significant effect on the gas pressure.

The shock absorption does not provide any protection against unsafe situations such as those which can occur very suddenly in practice. For example, in the case of hoisting mechanisms which are used at sea, for example on working ships or drilling installations, unsafe situations result from swell, sudden waves, movements of the ship and jamming of the hoisting hook or hoisting cable.

A need exists for a hoisting mechanism with an automatically operating, reliably functioning protection against overloading of the hoisting mechanism. In this way, the hoisting mechanism can effectively be provided with automatic protection against overloading, in particular against loads which occur very suddenly.

The embodiments meet these needs.

BRIEF DESCRIPTION OF THE DRAWINGS

The detailed description will be better understood in conjunction with the accompanying drawings as follows.

The embodiments are detailed below with reference to the listed Figures.

DETAILED DESCRIPTION OF THE EMBODIMENTS

Before explaining the embodiments in detail, it is to be understood that the embodiments are not limited to the particular embodiments and that they can be practiced or carried out in various ways.

The embodiments relate to hoisting mechanisms and to vessels provided with embodiments of the hoisting mechanism.

Figure 1:
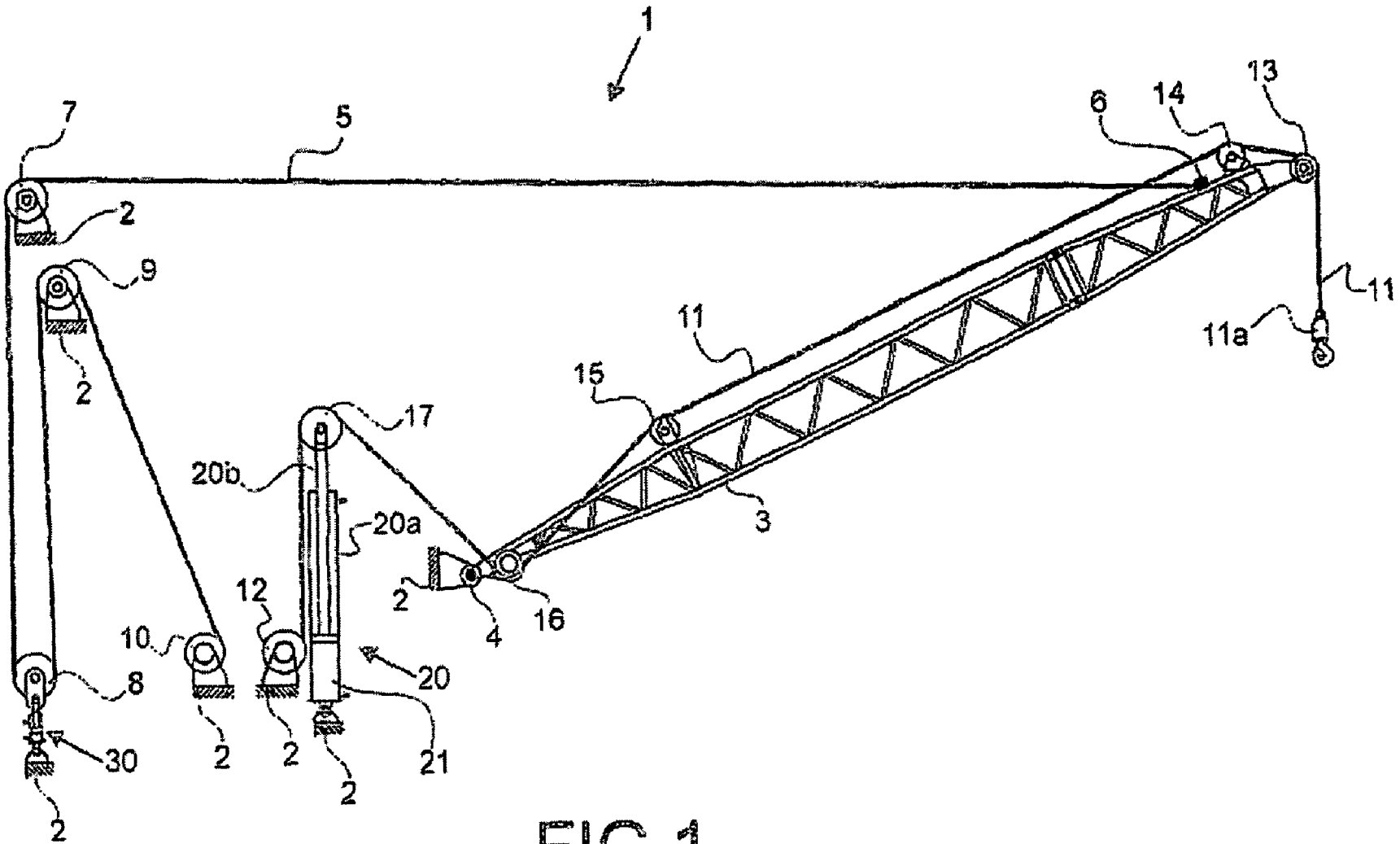
FIG. 1 depicts a highly diagrammatic illustration of a first exemplary embodiment of a hoisting mechanism.

With reference to the figures, FIG. 1 diagrammatically depicts an embodiment of a hoisting mechanism 1 with a frame 2 and a jib 3 that is connected to the frame 2 about a substantially horizontal pivot shaft 4. The hoisting mechanisms can take all kinds of embodiments, for example, on a vessel, on a drilling platform or the like, as a mast crane that is positioned on a base, or optionally such that the hoisting mechanism can rotate about a vertical axis.

The embodied hoisting mechanisms can be advantageous for applications at sea, but can provide the desired protection on land as well.

The hoisting mechanism 1 can include a topping means for raising and lowering the jib 3. The exemplary topping means depicted in FIG. 1 can include a topping cable 5 that engages on the jib 3 at a distance from the pivot shaft 4 (at the location indicated by 6). For example, the topping cable 5 can engage on the jib 3 in the vicinity of the free end of the jib 3. The topping cable 5 can run over a cable pulley 7, (for example, at the top of the mast if a mast crane is under consideration), a cable pulley 8, and/or a second cable pulley 9. The topping cable 5 can run over one or more of these pulleys to an associated topping-cable drive 10 (for example, in the form of an electrically or hydraulically driven drum winch). The jib can include one or more jib parts, wherein adjacent jib parts are pivotable about a substantially horizontal pivot shaft 85 with respect to one another. Each jib can have an associated topping means and an associated topping-means loading sensor.

The hoisting mechanism 1 can include a hoisting cable 11 and an associated hoisting-cable drive 12. As depicted, the hoisting cable can be an electrically or hydraulically driven drum winch. Hoisting-cable guide means define a path for the hoisting cable 11 between a hoisting-cable guide 13 and the hoisting-cable drive 12. The hoisting-cable guide 1 can be arranged on the jib 3 and from which the hoisting cable 11 with hoisting hook 11 a hangs downwards. As an example, the cable pulleys 14, 15, 16, and 17 define the path for the hoisting cable 11. As depicted in FIG. 1, the cable pulley 17 can be displaceable with respect to the frame 2, in such a manner that displacement of the displaceable cable pulley 17 changes the length of the path for the hoisting cable 11.

The topping cable and/or hoisting cable exampled in the figures can be a single cable or can be designed with numerous cable parts that run over one or more cable pulleys.

As depicted in FIG. 1, the first hydraulic component 20 can be a linear hydraulic cylinder with housing 20*a* and piston rod 20*b*, having a first chamber 21 of variable volume. The near hydraulic cylinder can be arranged between the frame 2 and the displaceable cable pulley 17.

The hoisting mechanism 1 can include a hydraulic topping-cable loading sensor 30 for detecting the loading on the topping cable 5. The topping-cable loading sensor 30 can be arranged between the frame 2 and the cable pulley 8. As depicted in FIG. 1, the sensor 30 can be a linear hydraulic cylinder with a housing 30*a*, which is connected to the frame 2 and a piston rod 30*b* that is connected to the topping-cable pulley 8. The sensor 30 can have a chamber 31 of variable volume so that the pressure of hydraulic fluid in the chamber is representative of the loading on the topping cable 5.

Figure 2:
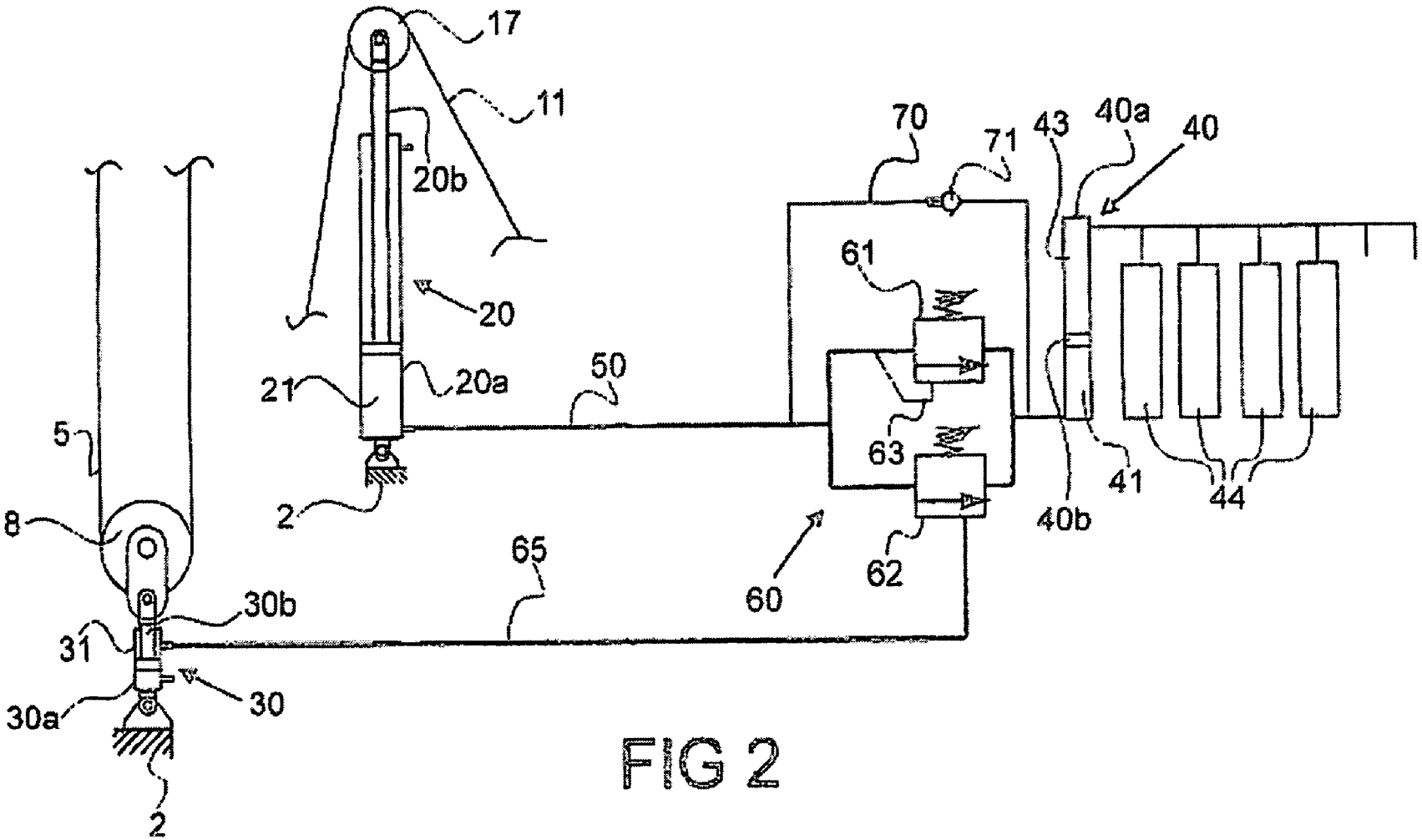
FIG. 2 diagrammatically depicts the relevant parts of the overload protection of the hoisting mechanism depicted in FIG. 1.

As depicted in FIG. 2, the hoisting mechanism 1 can have a second hydraulic component 40 with a second chamber 41 of variable volume. As depicted, the component 40 can be designed as a linear cylinder with a housing 40*a* and a piston 40*b*. The piston 40*b* can form a separation between the chamber 41, which is filled with hydraulic fluid, and a chamber 43, which is filled with a pressurized gas. A component 40 of this type is occasionally referred to as a medium separator. The chamber 43 with pressurized gas is connected to a reservoir for pressurized gas, such as a number of interconnected gas cylinders 44. The gas cylinders 44 and the chamber 43 together form a pressure source that maintains a substantially constant hydraulic pressure in the second chamber 41, irrespective of the volume of the chamber 41 (and therefore the position of the piston 40*b*). The effective pressure in the chamber 43 can be adjustable (for example, by an operator of the hoisting mechanism). By way of example, the pressure can set to be lower if the load to be hoisted is farther away from the frame of the hoisting mechanism. The gas cylinders 44 or other compressed-gas source can be replaced by a spring system or the like.

As depicted in FIG. 2, a connecting line 50 can be present between the first chamber 21 and the second chamber 41. A pressure-limiting valve assembly 60 with associated hydraulic actuating means can be incorporated in this connecting line 50. In the example embodiment of the assembly 60 depicted in FIG. 2, two pressure-limiting valves 61 and 62, are incorporated in parallel in the connecting line 50, but one or more limiting valves can be incorporated.

The pressure-limiting valve 61 is actuated hydraulically on the basis of the hydraulic pressure in the first chamber 21. The hydraulic pressure can be detected, as indicated by the diagrammatic control line 63. The pressure-limiting valve 61 is normally closed if the pressure detected in the first chamber 21 is below a predetermined hoisting-cable limit value which is representative of the permissible loading on the hoisting cable 11.

The pressure-limiting valve 61 opens the connection between the first chamber 21 and the second chamber 41 if the pressure detected in chamber 21 is above the predetermined hoisting-cable limit value. The result is that the hoisting-cable pulley 17 is supported by the gas pressure in chamber 43, which is substantially constant. The first hydraulic component 20 can permit a displacement of the displaceable hoisting-cable pulley 17 under the influence of the hoisting-cable loading, so that the length of the path of the hoisting cable 11 is reduced. In the process, hydraulic fluid flows out of the first chamber 21 and into the second chamber 41 via line 50 at the pressure defined by the pressure source 44. This paying out of the hoisting cable 11 automatically prevents overloading of the hoisting mechanism.

In an embodiment, the chamber 31 of the topping-cable loading sensor 30 can be connected to the hydraulic actuating means of the pressure-limiting valve 62, in this case via hydraulic control line 65.

The pressure-limiting valve 62 can include a connection between the first chamber 21 and the second chamber 41 that is opened if the pressure in the chamber 31 of the topping-cable loading sensor 30 is higher than a predetermined topping-cable limit value. If so, the first hydraulic component 20 permits a displacement of the displaceable hoisting-cable pulley 17 with hydraulic fluid flowing out of the first chamber 21 at the pressure defined by the pressure source 44. In this case, the hoisting cable can be paid out automatically.

A return line 70 with non-return valve 71 that closes in the direction of the second component 40 can be arranged in parallel with the pressure-limiting valve assembly 60. This embodiment allows hydraulic fluid to flow from the second chamber 41 to the first chamber 21 when the hoisting-cable loading decreases again.

In one embodiment, the limit values for the two valves 61 and 62 can be set to the same value.

As depicted in the figures, the embodiments can provide for an automatically operating protection against overloading of the hoisting mechanism, even if the overloading occurs very suddenly. This protection acts mechanically/hydraulically and does not involve the use of any electronics. Even in the event of complete electricity failure (such as, when the electrically driven winches 10 and 12 stop), the protection remains present.

The embodied hoisting-cable loading can be used for an optional second hoisting-cable system of the hoisting mechanism. In this case, an associated displaceable cable pulley and hydraulic component is provided for the second hoisting cable. The chamber of the hydraulic component can be connected together with the chamber of the hydraulic component of the first hoisting cable to a valve, by means of which the operator of the hoisting mechanism can connect the hoisting-cable system which he has put in operation to the pressure-limiting valve assembly. In an alternative embodiment, a dedicated pressure-limiting valve assembly for each hoisting-cable system can be used. The pressure-limiting valve assembly can be designed otherwise than as described here by way of example. For example, a single pressure-limiting valve that is actuated by the pressure in the chamber 21 and by the pressure in the chamber 31 can be used.

Figure 3:
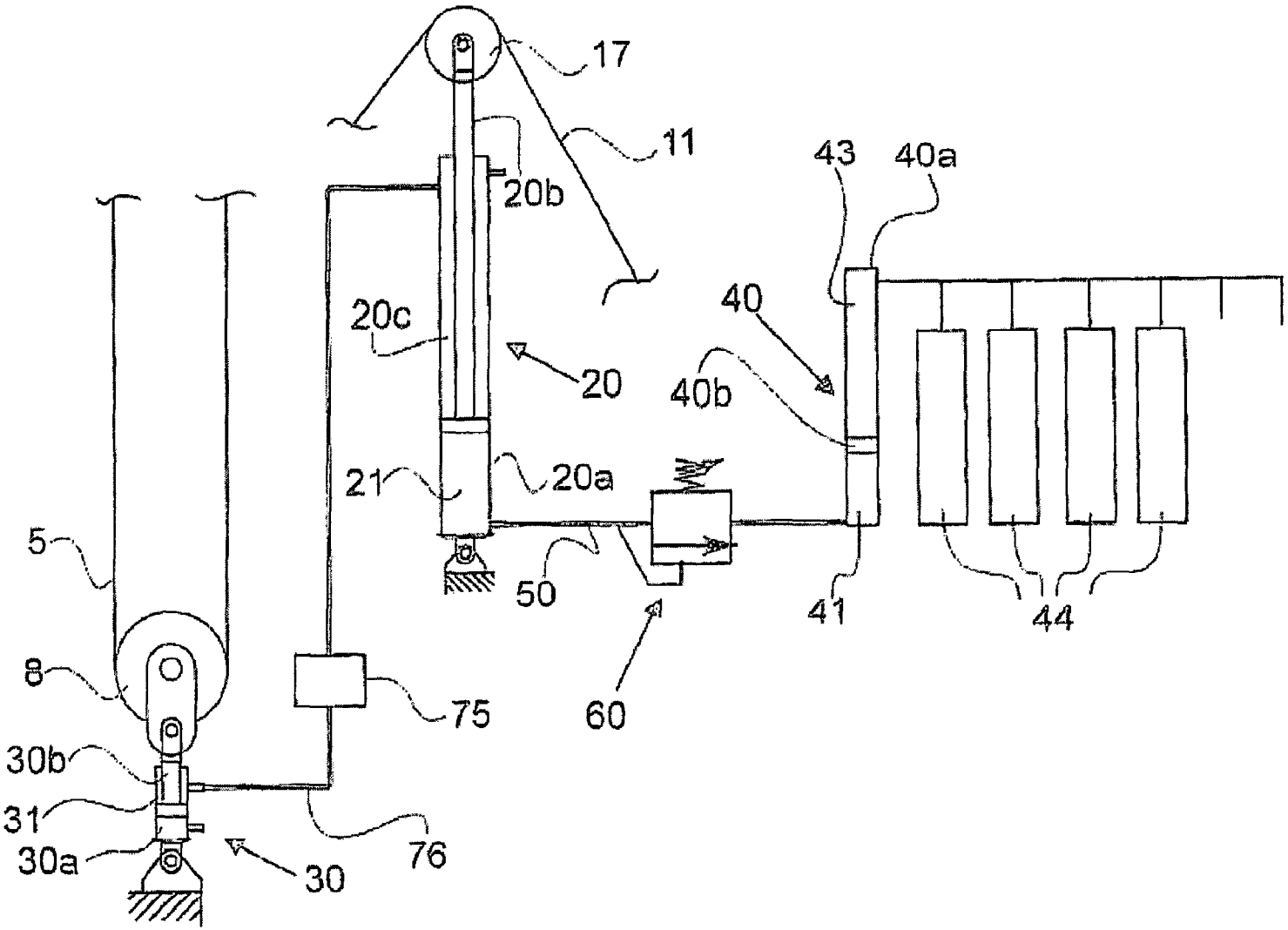
FIG. 3 depicts a variant embodiment on the circuit diagram depicted in FIG. 2.

FIG. 3 depicts an alternative embodiment of the circuit diagram depicted in FIG. 2. The chamber 31 of the topping-cable loading sensor 30 can be connected via a line 76 with a pressure-limiting valve 75 to the other chamber 20*c* of the first hydraulic component 20. A pressure-limiting valve assembly 60 can be incorporated in the line 50 between the first chamber 21 and the second chamber 41.

The valve 75 opens if the pressure in the chamber 31 exceeds a topping-cable limit value. In one example, the pressure acts on the piston rod side of the piston between the chamber 21 and the chamber 20*c*. Some of the pressure in chamber 31 is transferred to the first chamber 21 and to the hydraulic actuation of valve assembly 60. This "adding" of the pressure in chamber 31 to the pressure caused by the hoisting cable 11 in the chamber 21 supplies the control pressure, as a result of which the valve assembly 60 does or does not open.

Figure 4:
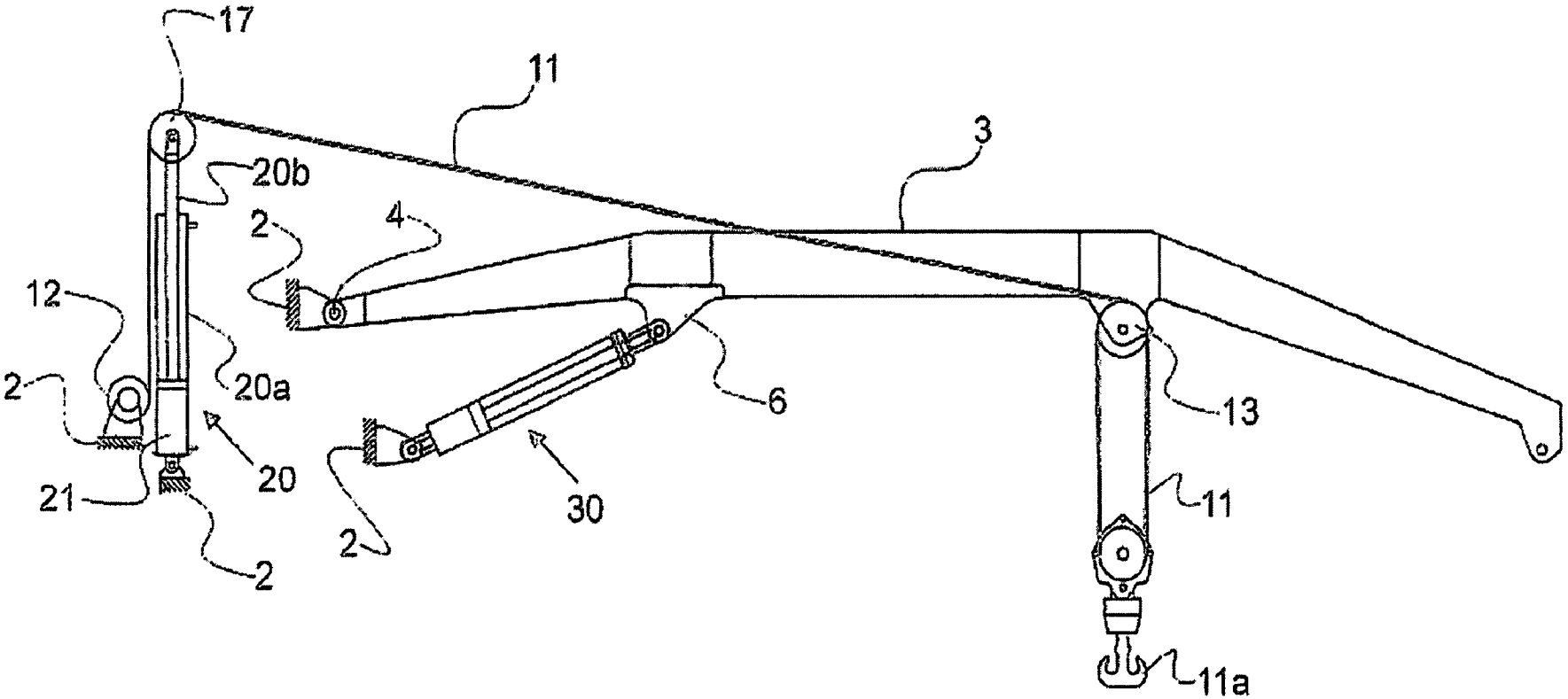
FIG. 4 depicts a second exemplary embodiment of the hoisting mechanism.

FIG. 4 depicts a hoisting mechanism in which parts corresponding to the hoisting mechanism depicted in FIG. 1 are provided with identical reference numerals. The hoisting cable system is substantially unchanged; however, one or more hydraulic topping cylinders 30 are provided between the frame 2 and the jib 3 for the purpose of raising and lowering the jib 3.

Figure 5:
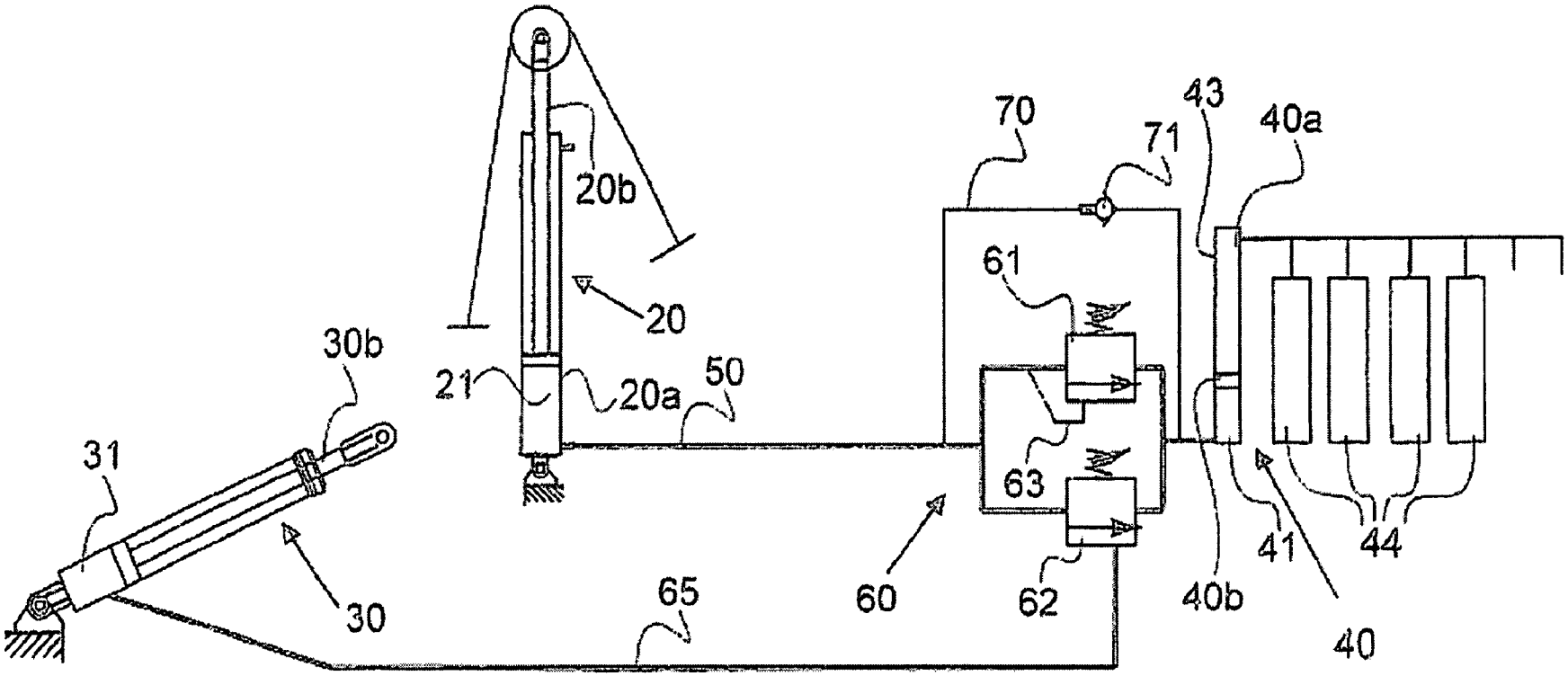
FIG. 5 diagrammatically depicts the relevant parts of the overload protection of the hoisting mechanism depicted in FIG. 4.

FIG. 5 depicts a circuit diagram associated with the embodiment depicted in FIG. 4. The cylinder 30 used for topping of the jib 3 can serve as a topping-means loading sensor in the context of providing protection against overloading of the hoisting mechanism. In this case, the chamber 31 of the topping cylinder 30, which leads to the jib being raised when hydraulic fluid is supplied to the jib, is connected via line 65 to the hydraulic actuating means of pressure-limiting valve 62.

Figure 6:
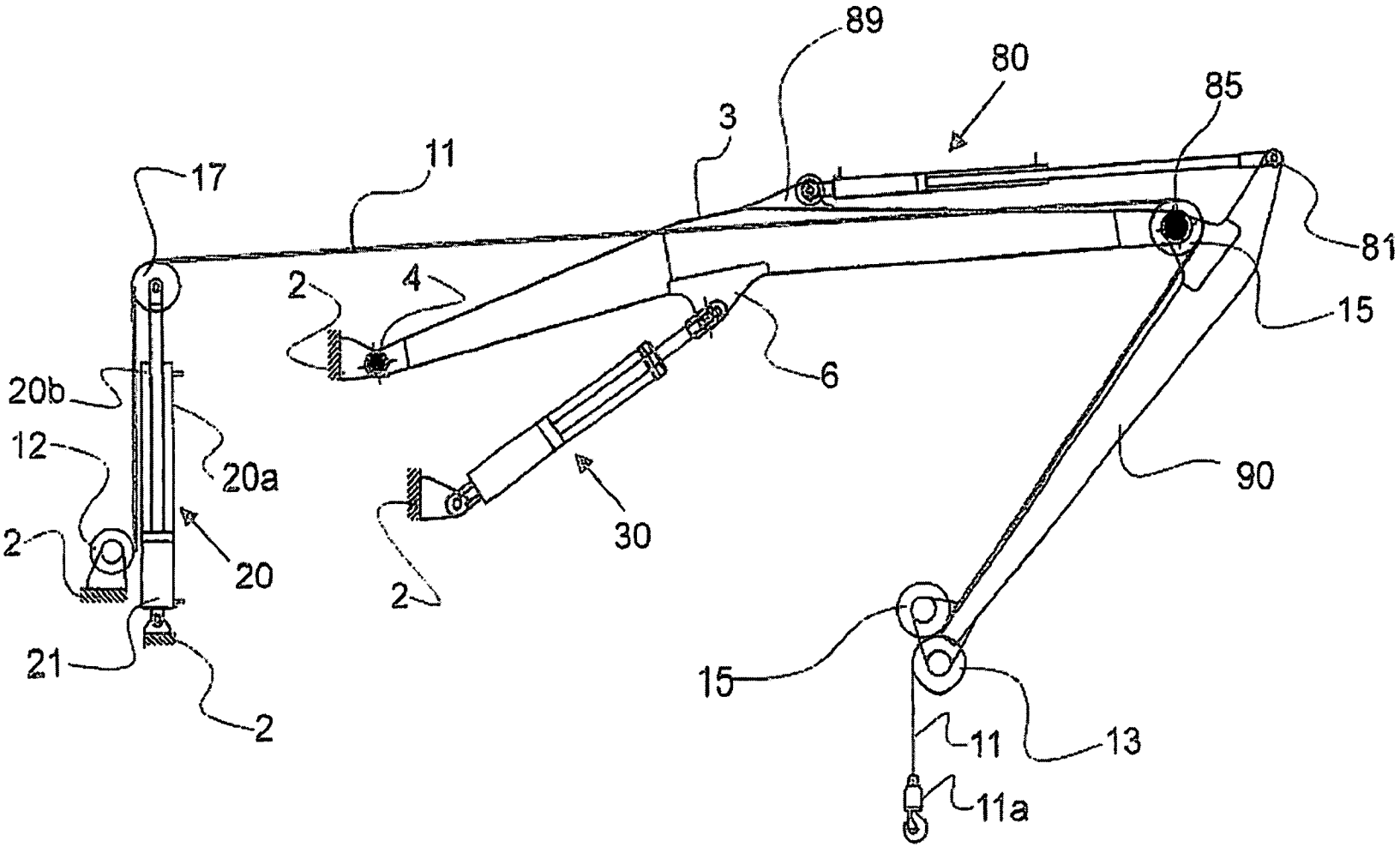
FIG. 6 depicts a third exemplary embodiment of the hoisting mechanism.

FIG. 6 depicts a hoisting mechanism with a two-part jib provided with jib part 3 and jib part 90. The jib part 90 is connected to jib part 3 about a horizontal pivot shaft 85. Associated topping means can be provided for raising and lowering the jib part 90. In this example, the topping means can include a hydraulic topping cylinder 80 between the jib parts 3 and 90 with a point of engagement 81 on jib part 90 and point of engagement 89 on jib part 3.

Figure 7:
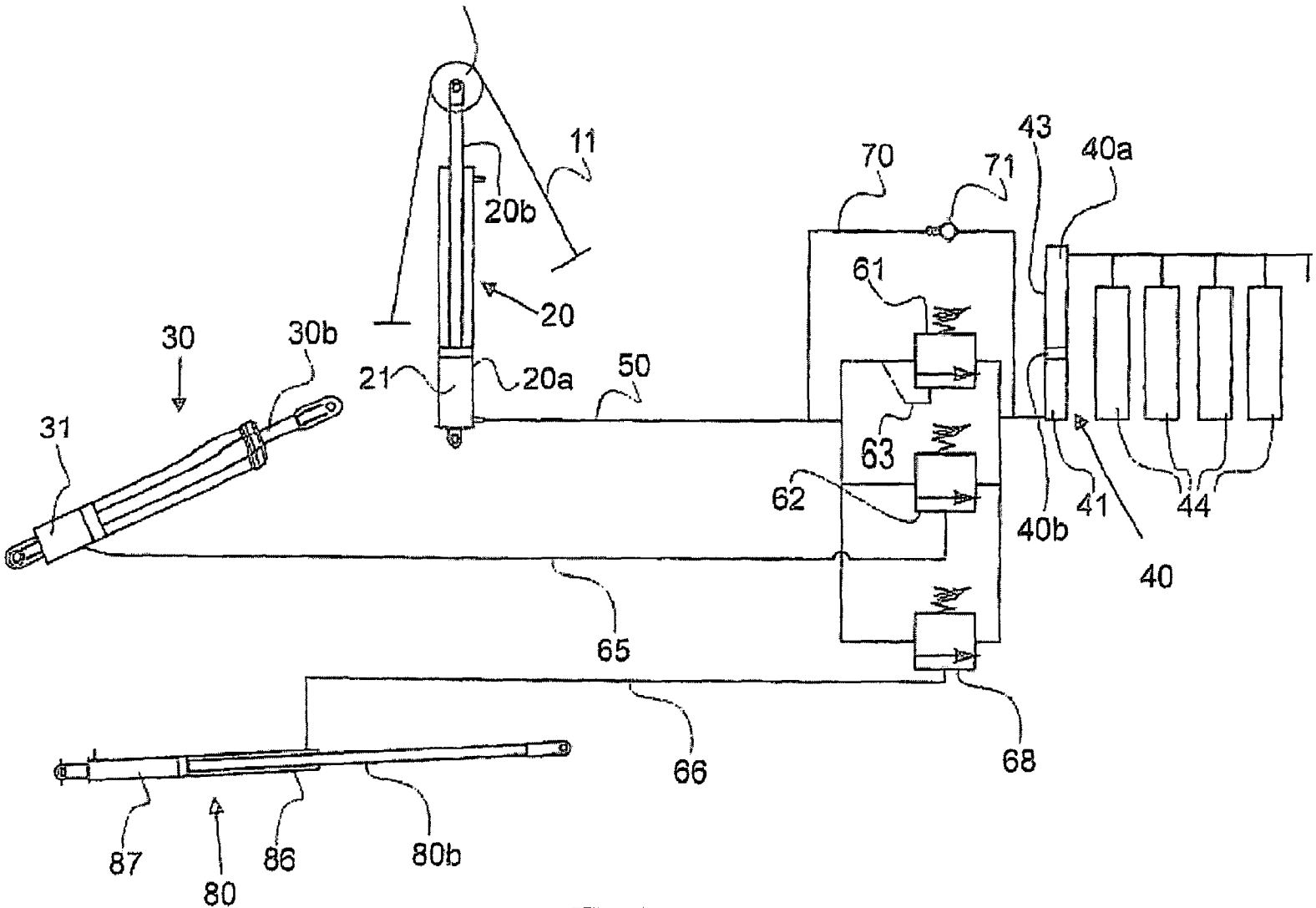
FIG. 7 diagrammatically depicts the relevant parts of the overload protection of the hoisting mechanism depicted in FIG. 6.

FIG. 7 depicts a circuit diagram for a protection arrangement associated with the embodiment depicted in FIG. 6. For each topping cylinder 30 and 80, the chambers 31 and 86 responsible for raising the associated jib part are connected to the hydraulic actuating means of a pressure-limiting valve 62 and 68. Control lines 65 and 66 are provided for this purpose.

The valves 62 and 68 can be in parallel with the valve 61 in the line 50, so that the connection between the chambers 21 and 41 is opened if the pressure in a topping cylinder 30 and 80 rises above the associated limit value.

Figure 8:
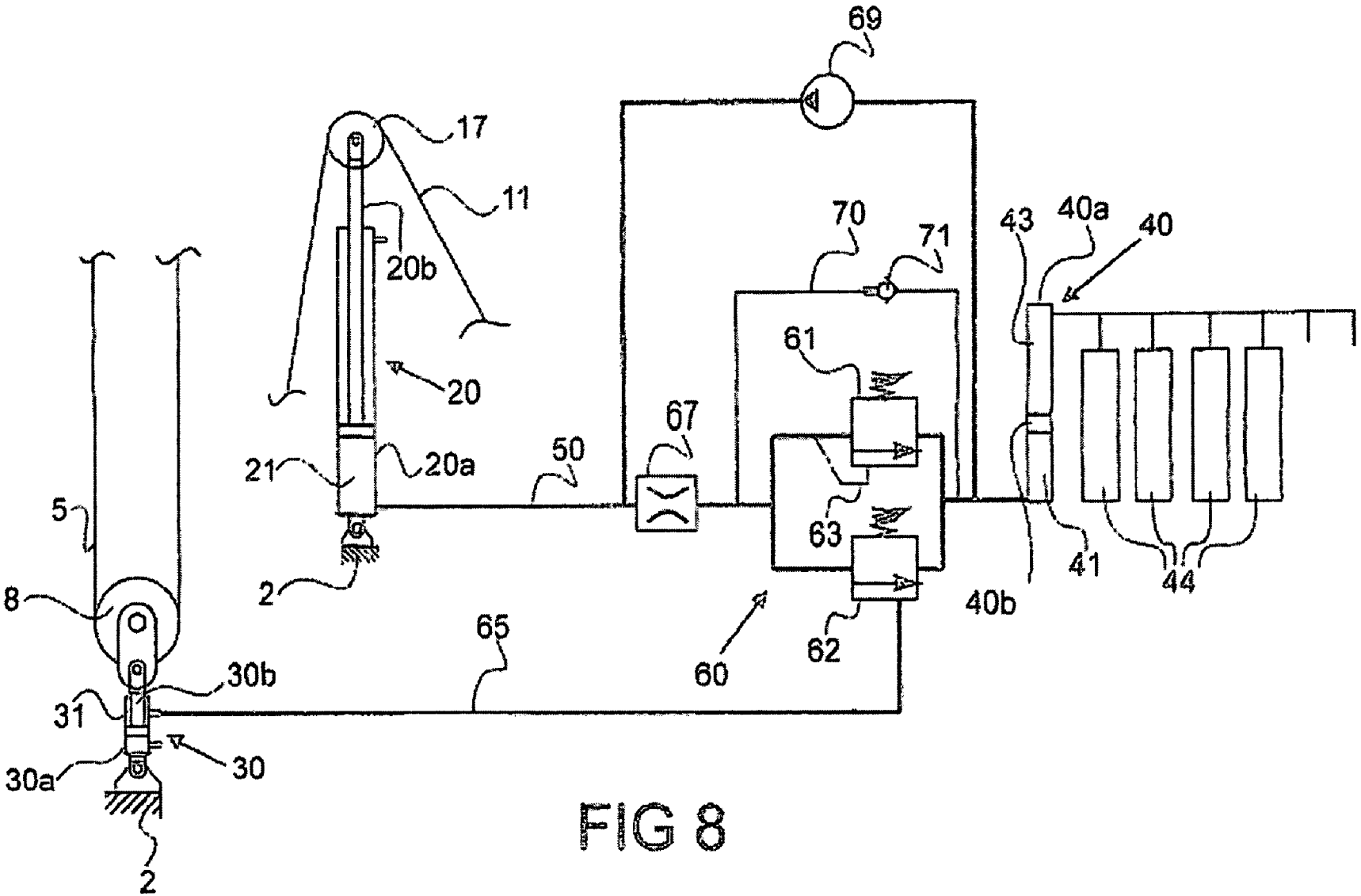
FIG. 8 diagrammatically depicts the relevant parts of a variant of the overload protection depicted in FIG. 2.

FIG. 8 depicts an alternative embodiment of the protection arrangement illustrated in FIG. 2. In this case, a throttle valve 67 can be provided in the line 50 between the first chamber 21 and the pressure-limiting valve assembly 60. The throttle valve 67 can be used to prevent rapid movements of the load hanging from the hoisting hook 11 a if a major pressure difference between the first chamber 21 and the second chamber 41 exists.

In FIG. 8, a pump 69 is arranged in parallel with the pressure-limiting valve assembly 60 and the throttle valve 67. The pump 69 is connected on one side to the first chamber 21 and on the other side to the chamber 41. The pump 69 can be used for the rapid supply of hydraulic fluid to the first chamber 21 if this is desired.

In an alternative embodiment, signaling means can be used if the pressure-limiting valve assembly 60 opens the connection between the chambers 21 and 41. The signaling means allow the hoisting-cable drive 12 to be activated, so that the hoisting cable 11 is paid out (for example, at a maximum normal speed) in order to protect the hoisting mechanism against overloading.

In the embodiments, a topping-means loading sensor can be connected to the pressure-limiting valve assembly via electronic means. In alternative embodiments of the hoisting mechanism, the hoisting mechanisms do not require electronic means in the context of the overload protection described. In the case of vessels, such as in the case of offshore working ships, from time to time electrical faults occur causing simultaneous failure of all electrical systems. In this case, a separate electrical voltage source can be supplied for supplying power to these electronic means. The topping-means loading sensor can be in communication with the pressure-limiting valve assembly via electronic means. The topping-means loading sensor can, alternatively, be mechanically connected to the pressure-limiting valve assembly.

While these embodiments have been described with emphasis on the embodiments, it should be understood that within the scope of the appended claims, the embodiments might be practiced other than as specifically described herein.

What is claimed is:

1. A hoisting mechanism comprising:

a. a frame;

b. a jib connected to the frame about a substantially horizontal pivot shaft;

c. topping means for raising and lowering the jib;

d. a hoisting cable and a hoisting-cable drive;

e. hoisting-cable guide means that define a path for the hoisting cable between the hoisting-cable drive and a hoisting-cable guide arranged on the jib, from which the hoisting cable hangs downwards; and f. a device for limiting the loading on the hoisting mechanism, comprising:

i. a hoisting-cable guide for the hoisting cable, wherein the hoisting-cable guide is displaceable with respect to the frame or the jib, wherein the displacement of the hoisting-cable guide changes the length of the path;

ii. a first hydraulic component arranged between the frame or jib and the displaceable hoisting-cable guide, wherein the first hydraulic component comprises a first chamber of a first variable volume;

iii. a second hydraulic component comprising a second chamber with a second variable volume;

iv. a pressure source connected to the second hydraulic component in order to maintain a substantially constant hydraulic pressure in the second chamber; and v. a connection between the first chamber and the second chamber, wherein the connection comprises a pressure-limiting valve assembly and actuating means, wherein the actuating means detects pressure in the first chamber.

2. The hoisting mechanism of claim 1, further comprising a topping-means loading sensor connected to the pressure-limiting valve assembly.

3. The hoisting mechanism of claim 2, wherein the pressure-limiting valve assembly opens the connection if the load detected by the topping-means loading sensor is higher than a predetermined topping-means limit value, so that the first hydraulic component permits a displacement of the displaceable hoisting-cable guide, with hydraulic fluid flowing out of the first chamber at the pressure defined by the pressure source.

4. The hoisting mechanism of claim 2, wherein the pressure-limiting valve assembly flirt her comprises a first pressure-limiting valve and a second pressure-limiting valve, wherein the first pressure-limiting valve controls pressure in the first chamber and the second pressure-limiting valve is connected to the topping-means loading sensor.

5. The hoisting mechanism of claim 2, wherein the topping-means loading sensor is a hydraulic sensor, wherein the topping-means loading sensor comprises a third chamber of third variable volume, wherein the pressure of fluid in the third chamber is representative of the load on the topping means.

6. The hoisting mechanism of claim 5, wherein the third chamber is connected to the actuating means of the pressure-limiting valve assembly, wherein the pressure-limiting valve assembly opens the connection if the pressure in the third chamber is higher than a predetermined topping-means limit value, so that the first hydraulic component permits a displacement of the displaceable hoisting-cable guide.

7. The hoisting mechanism of claim 5, wherein the topping means comprise a hydraulic topping cylinder for raising and lowering the jib, wherein the hydraulic topping cylinder comprises a raising chamber for hydraulic fluid, wherein the hydraulic topping-means loading sensor is in communication with the raising cylinder.

8. The hoisting mechanism of claim 1, wherein the pressure-limiting valve assembly comprises a first pressure-limiting valve, and a second pressure-limiting valve, and a third pressure-limiting valve, wherein the first pressure-limiting valve controls pressure in the first chamber, wherein the second pressure-limiting valve is connected to second topping-means loading sensor, and the third pressure-limiting valve is connected to a third topping-means loading sensor.

9. The hoisting mechanism of claim 1, wherein the pressure-limiting valve assembly opens the connection if the pressure in the first chamber is above a predetermined hoisting-cable limit value, so the first hydraulic component allows a displacement of the displaceable hoisting-cable guide to reduce the length of the path.

10. The hoisting mechanism of claim 1, wherein the pressure-limiting valve assembly further comprises signaling means, wherein the signaling means actuates the hoisting-cable drive to pay out the hoisting cable if the pressure-limiting valve assembly opens the connection between the first chamber and the second chamber.

11. The hoisting mechanism of claim 1, wherein the jib comprises a plurality of jib parts, wherein adjacent jib parts are pivotable about a substantially horizontal pivot shaft with respect to one another, each jib is associated with topping means.

12. The hoisting mechanism of claim 1, further comprising a common pressure-limiting valve assembly and a common pressure-limiting control valve is positioned between the hydraulic components of additional devices for limiting the loading on the hoisting mechanism.

13. The hoisting mechanism of claim 1, further comprising a pump is connected in parallel to the pressure-limiting valve assembly, wherein the pump supplies hydraulic fluid to the first chamber.

14. The hoisting mechanism of claim 1, wherein the connection comprise a throttle valve between the first chamber and the second chamber.

* * * * *